US007188677B2

(12) United States Patent
Moe

(10) Patent No.: US 7,188,677 B2
(45) Date of Patent: Mar. 13, 2007

(54) TENSIONING SYSTEM FOR PRODUCTION TUBING IN A RISER AT A FLOATING INSTALLATION FOR HYDROCARBON PRODUCTION

(75) Inventor: Magne Mathias Moe, Harstad (NO)

(73) Assignee: National Oilwell Norway AS, Stavanger (NO)

( * ) Notice: Subject to any disclaimer, the term of this patent is extended or adjusted under 35 U.S.C. 154(b) by 0 days.

(21) Appl. No.: 10/528,667

(22) PCT Filed: Nov. 13, 2003

(86) PCT No.: PCT/NO03/00384

§ 371 (c)(1),
(2), (4) Date: Mar. 22, 2005

(87) PCT Pub. No.: WO2004/057147

PCT Pub. Date: Jul. 8, 2004

(65) Prior Publication Data

US 2005/0263288 A1 Dec. 1, 2005

(30) Foreign Application Priority Data

Nov. 20, 2002 (NO) ..... 20025556

(51) Int. Cl.
*E21B 7/12* (2006.01)

(52) U.S. Cl. ..... 166/355; 166/352; 166/367; 166/385; 175/5

(58) Field of Classification Search ..... 166/355, 166/352, 367, 385, 341–343, 357, 105; 175/5, 175/7; 405/224.2–224.4
See application file for complete search history.

(56) References Cited

U.S. PATENT DOCUMENTS

| | | | | |
|---|---|---|---|---|
| 3,421,581 | A * | 1/1969 | Van Geijn | 166/355 |
| 3,681,928 | A * | 8/1972 | Vincken et al. | 405/196 |
| 4,258,792 | A * | 3/1981 | Restarick | 166/378 |
| 4,272,059 | A * | 6/1981 | Noerager et al. | 254/392 |
| 4,432,420 | A | 2/1984 | Gregory et al. | |
| 4,702,320 | A * | 10/1987 | Gano et al. | 166/343 |
| 5,069,488 | A | 12/1991 | Freyer et al. | |
| 5,479,990 | A * | 1/1996 | Peppel | 166/350 |
| 5,524,710 | A * | 6/1996 | Shinn | 166/348 |
| 5,944,111 | A * | 8/1999 | Bridges | 166/348 |
| 6,293,345 | B1 | 9/2001 | Watkins | |
| 6,321,848 | B1 * | 11/2001 | Funk | 166/383 |
| 6,419,024 | B1 * | 7/2002 | George et al. | 166/377 |
| 6,516,887 | B2 * | 2/2003 | Nguyen et al. | 166/348 |
| 2001/0040052 | A1 * | 11/2001 | Bourgoyne et al. | 175/7 |

FOREIGN PATENT DOCUMENTS

| | | |
|---|---|---|
| NO | 308379 | 9/2000 |
| WO | WO 91/77483 | 10/2001 |

* cited by examiner

*Primary Examiner*—Patricia Engle
*Assistant Examiner*—Christopher Buchanan
(74) *Attorney, Agent, or Firm*—Andrus, Sceales, Starke & Sawall, LLP

(57) ABSTRACT

A device for tensioning and relieving production tubing (49) extending from a subsea hydrocarbon well (107) up through a riser (63) to a floating installation (87), a continuous production tubing extension (85) passing through a telescopic unit (67) in the upper part of the riser (63), preferably extending above a production deck (89) on the floating installation (87), where the production tubing (49) is provided with a tubing tensioner unit (1) below and in the proximity of the lower end of the telescopic unit (67).

7 Claims, 5 Drawing Sheets

TENSIONING SYSTEM FOR PRODUCTION TUBING IN A RISER AT A FLOATING INSTALLATION FOR HYDROCARBON PRODUCTION

CROSS REFERENCE TO RELATED APPLICATION

The present application is the U.S. national stage application of International Application PCT/NO2003/000384, filed Nov. 13, 2003, which international application was published on Jul. 8, 2004 as International Publication WO 2004/057147. The International Application claims priority of Norwegian Patent Application 20025556, filed Nov. 20, 2002.

BACKGROUND OF THE INVENTION

This invention regards a tensioning device for production tubing installed in a riser connecting a subsea hydrocarbon well with a floating installation on the surface of the sea, in particular a system for tensioning the fixed part of the production tubing and relieving it by suspending it from the fixed part of the riser, and also maintaining tension in that part of the production tubing which passes through a telescopic riser unit up to the production deck, by connecting a counterweight to the production tubing by means of a wire suspended from a pulley in the derrick.

During test production from a subsea hydrocarbon well by use of a floating installation in the form of a drilling platform or a drilling ship, the well and the floating installation are usually interconnected by several connecting pipes, among other things production tubing through which hydrocarbons flow up from the well. Several pipes may be gathered in a so-called riser of a dimension suitable for the purpose.

The actual riser is kept under tension by means of a riser tensioner attached to the floating installation. In order to compensate for movements of the floating installation caused by waves, tide, ballast trimming etc., the upper section of the riser comprises a telescopic section, which in some cases is combined with the riser tensioner. Some of the pipe connections inside the riser may have a similar telescopic section.

Under normal circumstances, it is not desirable for the production tubing to comprise a telescopic section. As a result, this is normally passed rigidly through the telescopic section of the riser and up to the production deck of the installation, where it is suspended from the tensioning system via wires, which tensioning system consists of pulleys and cylinders interconnected in a manner such as to maintain the tension in the production tubing regardless of the movements of the installation on the surface of the sea.

If the production tubing is not kept under tension, it may buckle under its own weight and possibly collapse, causing leakage. For this reason, the demands placed on the tensioners used on production tubing during this test phase are quite stringent. At the same time, the tensioners often comprise large, complex components that are demanding in terms of maintenance and which require a lot of space in the central areas around the production deck on the installation. For reasons of safety, it is often made use of dual systems. Consequently, the production tubing tensioners also represent a great load on the installation, with a relatively high centre of gravity.

The object of the invention is to remedy the disadvantages of prior art.

SUMMARY OF THE INVENTION

The object is achieved by characteristics given in the description below and in the following claims.

The tension in a riser is maintained in a manner that is known per se, by use of a tensioner comprising e.g. a tension collar attached to an upper section of the riser and further connected via wires to a system of pulleys and cylinders suitable for maintaining a prescribed tension in the riser. Alternatively, the tension may be maintained by a combined telescopic and tensioning device mounted in the extension of the upper part of the riser.

A tubing tensioner unit is interposed between a telescopic section and the upper section of the riser. A connection from the well via the production tubing passes centrally through the tubing tensioner unit. The tubing tensioner unit primarily comprises a housing and a tubular cylinder.

The housing of the tubing tensioner unit is essentially a concentric tube, the end portions of which are provided with flanges suitable for complementary connection to the upper section of the riser located below and the lower end of the telescopic section located above. Said parts are rigidly mounted to each flange connection with the use of several bolts.

The tubular cylinder comprises a piston section and a cylinder section.

The piston section comprises a tube with an inner diameter essentially equal to the dimension of the production tubing for which the tubing tensioner unit is intended. A middle section of the tube is provided with a concentric piston with a diameter considerably greater than the outer diameter of the tube. The piston section is connected to the production tubing sections located above and below, by use of threaded connecting sockets that are known per se. The piston casing is provided with appropriate packings.

The cylinder section comprises a cylinder and lower and upper gables with associated packings in concentric openings that match the outer diameter of the piston section. The inner diameter of the cylinder is adapted to the outer piston diameter of said piston section. Preferably, the upper gable of the cylinder section is removable through being provided with male threads that correspond to female threads in the cylinder. The tube and its piston are arranged inside the cylinder section with the ends of the tube projecting from the gables of the cylinder. The piston divides the cylinder into an upper and a lower chamber.

The lower gable of the cylinder section comprises a cylindrical portion that extends down from the end of the cylinder. The casing of the cylindrical portion is provided with several recesses each designed to accommodate a ratchet suspended in a swivelling manner from the upper end portion of the ratchet. The ratchet swivels out primarily in a radial direction from the cylindrical gable portion, so that the lower portion of the ratchet projects from the gable portion. Typically, the lower end face of the ratchet points downwards at an angle and out from its border against the inside face of the ratchet. The ratchets are essentially spaced evenly and concentrically around the gable portion. Each ratchet is provided with means of exerting a pressure against the inside of the ratchet, e.g. in the form of a compression spring, so that the ratchet swings out from its recess when the space outside the ratchets is unobstructed.

The cylinder section is provided with an inlet for supply of fluid, e.g. hydraulic oil, to the lower chamber of the cylinder. The inlet is connected to a hydraulic unit that is known per se, complete with pump, reservoir and control devices, in a manner that is known per se.

The inside wall of the housing of the tubing tensioner unit is provided with an annular recess designed to leave room for the protruding ratchets of the gable portion when the cylinder has been inserted into the housing of the tubing tensioner unit. A lower edge of the recess faces down and out at an angle from its border against the housing wall surface. The orientation of the lower edge typically coincides with the lower end face of the ratchets when the ratchets have been swung into the annular recess.

When the tensioning system according to the invention is used, the housing of the tubing tensioner unit is coupled to the riser at a suitable height above the seabed, whereupon the telescopic section is coupled to the upper end of the housing by means of the appropriate flanges. When the well is to be tested, the production tubing is assembled and lowered successively through the riser. The tubular cylinder is connected to the production tubing at an appropriate distance from the lower end of the production tubing, to allow the tubular cylinder to assume its position in said housing when the lower end of the production tubing is connected to the wellhead installation on the seabed. The axial position of the cylinder on the production tubing, which has been extended by the piston section of the tubular cylinder, is adjusted so as to make the ratchets on the tubular cylinder engage the annular recess in the housing.

When the ratchets of the tubular cylinder are engaged with the housing, the lower chamber of the tubular cylinder is pressurised hydraulically by means of the hydraulic unit. This tensions the production tubing, as the reaction forces from the tubular cylinder are transferred to the riser via the ratchets and the housing of the tubing tensioner, which is placed at the top of the riser.

Connected to the top of the riser is a production tubing extension which runs continuously through a telescopic unit that is known per se, and up above the production deck of the installation.

The upper end portion of the production tubing extension is connected to one end of a wire in a manner that is known per se. The wire is passed over a pulley device arranged considerably higher than the production deck, e.g. in the derrick. The other end of the wire is connected to a freely suspended counterweight with a mass adapted to the weight of the production tubing extension.

With this, a constant tension is maintained in the production tubing extension independently of the movements of the installation caused by waves, tide, ballast trimming etc. The tension is maintained by means of a simple and light-weight mechanism.

BRIEF DESCRIPTION OF THE DRAWING

The following describes a non-limiting example of a preferred embodiment illustrated in the accompanying drawings, in which.

Figure 1:
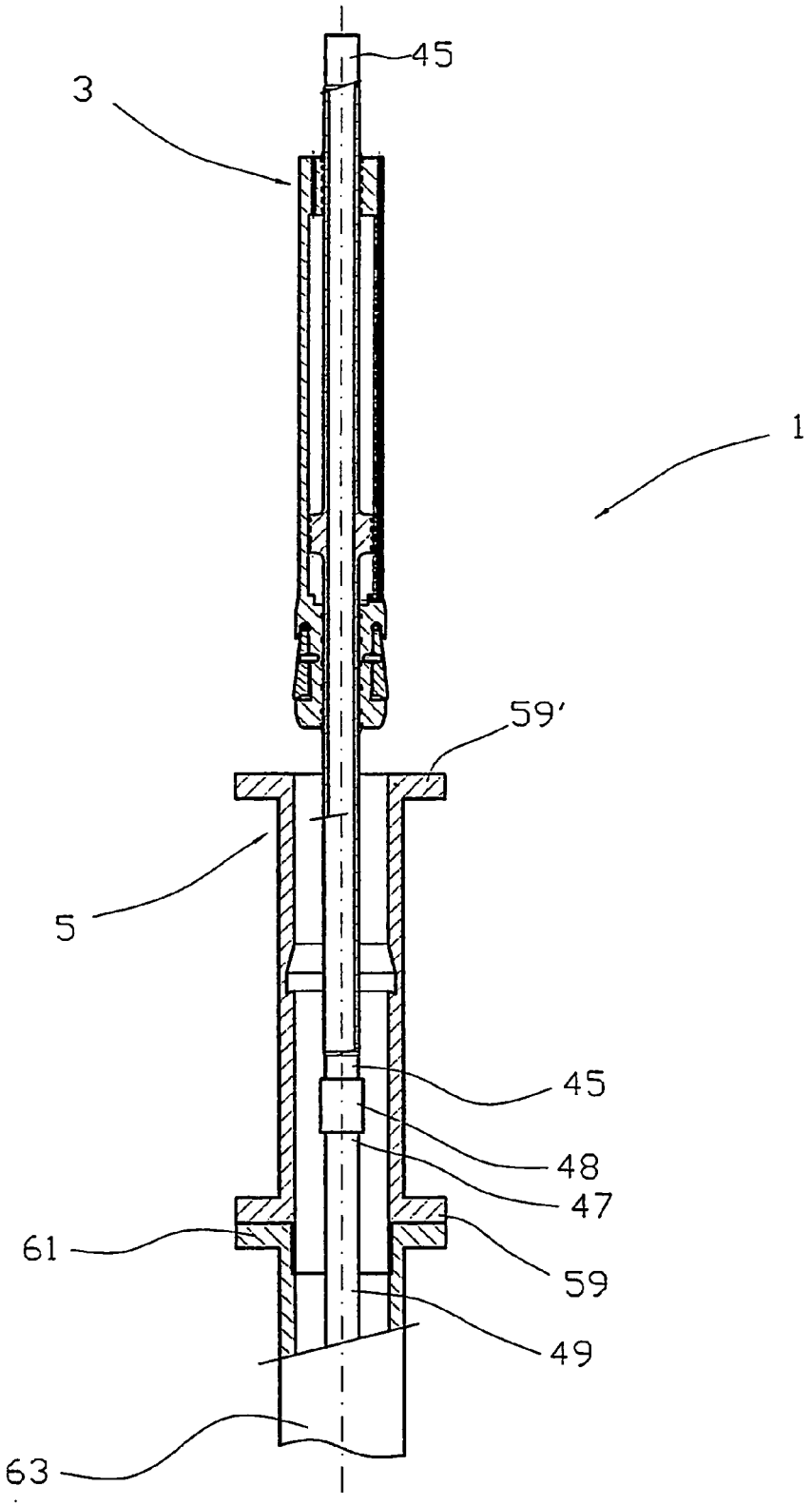
FIG. 1 shows a longitudinal section through a tubular cylinder connected to production tubing and about to be lowered through a riser, which is coupled to the housing of a tubing tensioner unit.

In the drawings, reference number 1 denotes a tubing tensioner unit consisting of a tubular cylinder 3 and a housing 5, see FIG. 1.

DETAILED DESCRIPTION OF THE INVENTION

In the following, reference is made to FIG. 3. The tubular cylinder 3 consists of a cylinder 7, an upper gable 9 and a lower gable 11. Both gables 9, 11 have a central circular opening 13 provided with several packings 15. The upper gable 9 is provided with a through air passage 17 and a hydraulic passage 19 for introduction of hydraulic fluid to the tubular cylinder 1. The hydraulic passage 19 follows the wall of the cylinder 7 and ends up in the tubular cylinder by the lower gable 11.

The lower gable 11 extends cylindrically out from the cylinder 7 in the axial direction, with a diameter that substantially is slightly larger than the outer diameter of the cylinder 7. The jacket 21 of the lower gable 11 is provided with several uniform cutouts 23.

In each cutout 23 a ratchet 25 is suspended from the gable 11 in a swivelling manner with an axle 27 through an upper part 29 of the ratchet 25. A longitudinal section through the ratchet and in the radial direction of the gable 11 shows the thickness of the ratchet 25 as decreasing from the lower part 31 to the upper part 29. An inner ratchet face 33 is provided with a recess. 35. A lower ratchet face 37 extends away from the inner ratchet face 33 and partly downwards at an angle. The cutout 23 has a recess 39 corresponding to the recess 35 in the ratchet 25. A spring device 41 capable of forcing the ratchet out is arranged with its ends in the recesses 35, 39.

A tubular piston rod 43 with end portions 45 threaded at both ends has an internal diameter of the same order as on a production tubing 49. The end portion 47 of the production tubing 49 is threaded correspondingly, and two corresponding end portions 45, 47 are joined with a sleeve 48 provided with female threads. In a middle section 51 the piston rod is provided with a concentric piston 53 that corresponds to the inner diameter of the cylinder 7. The piston 53 is provided with appropriate packings 55.

Figure 2:
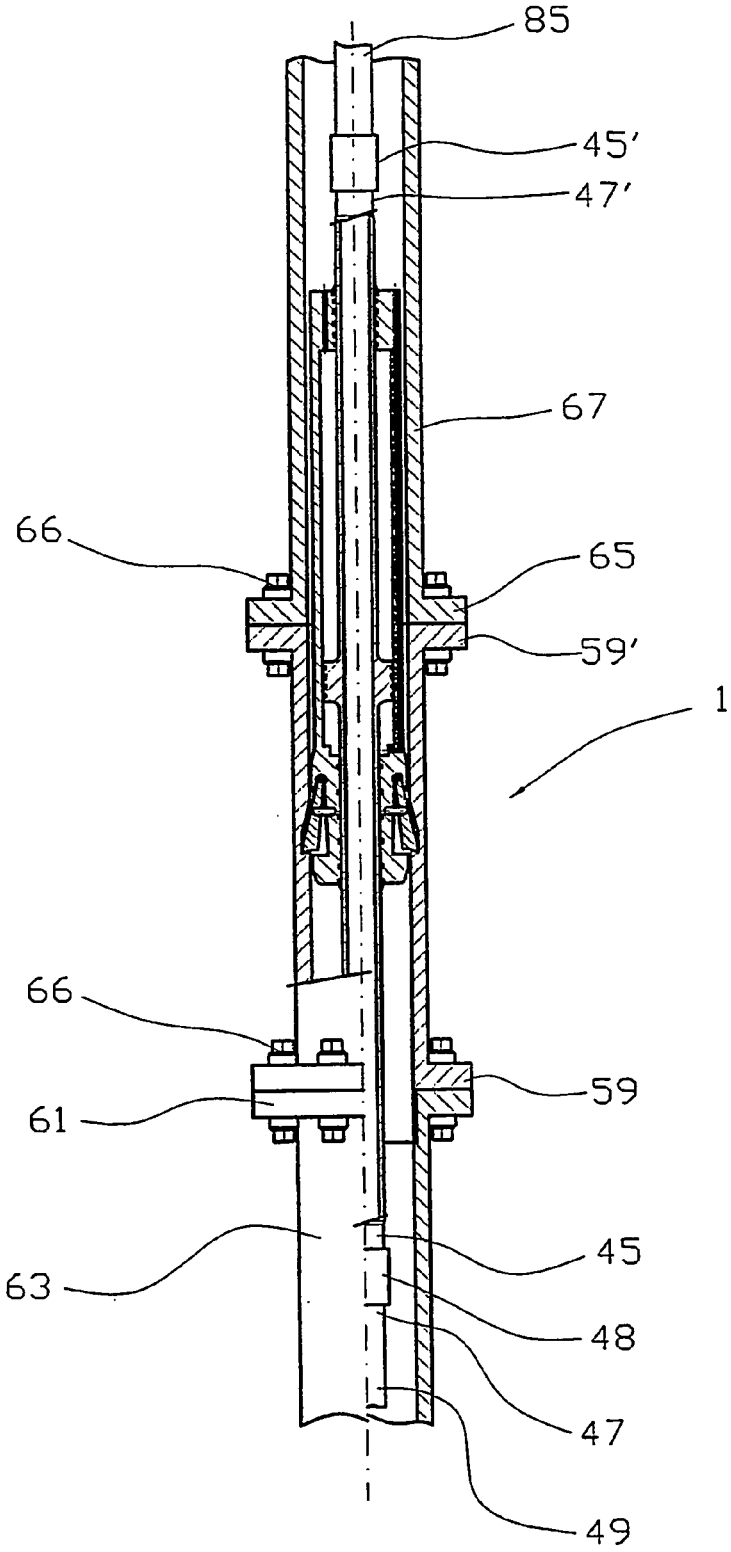
FIG. 2 shows a longitudinal section through a tubing tensioner unit connected to the riser, on the same scale.
Figure 3:
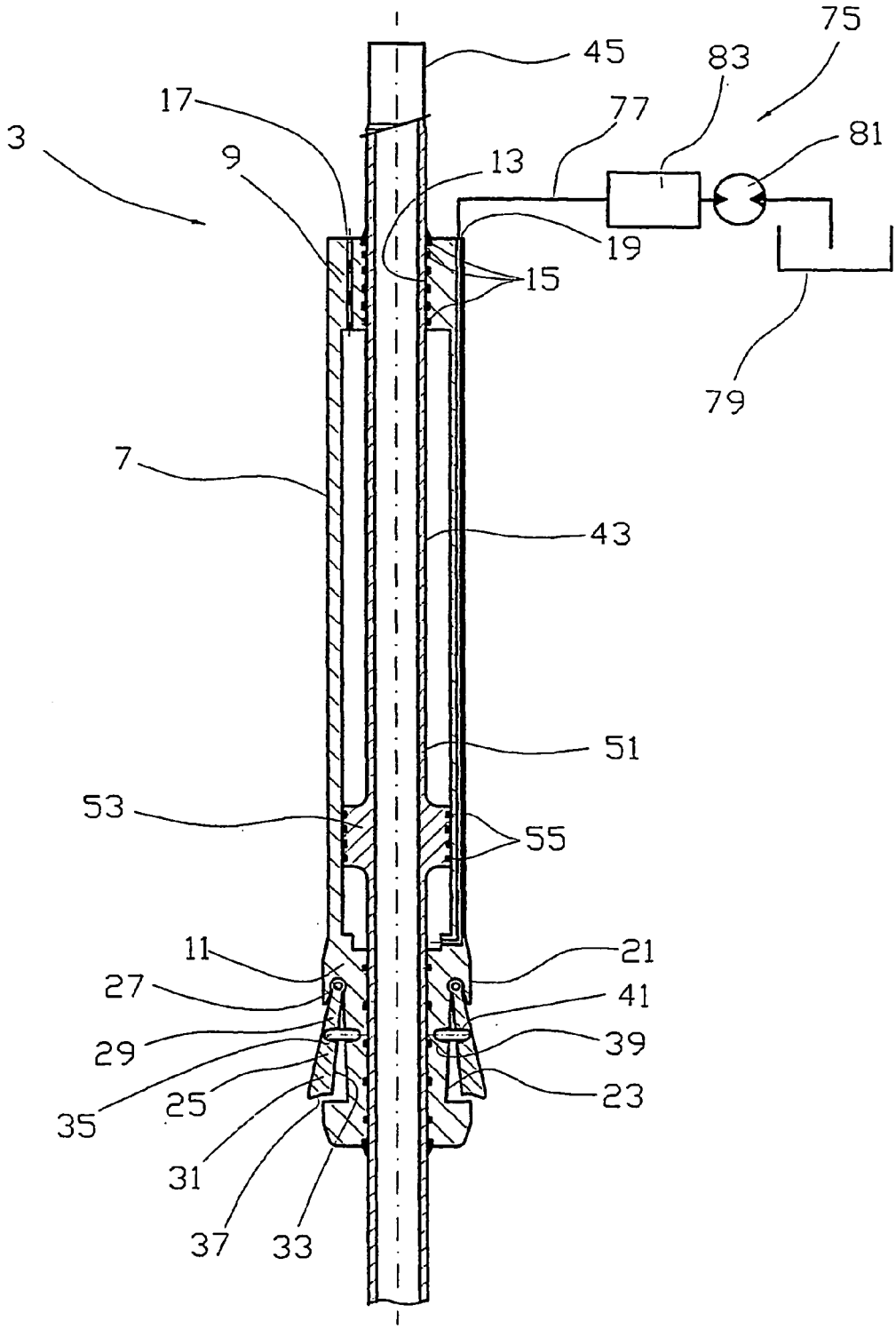
FIG. 3 shows a longitudinal section through the tubular cylinder, on the same scale.
Figure 4:
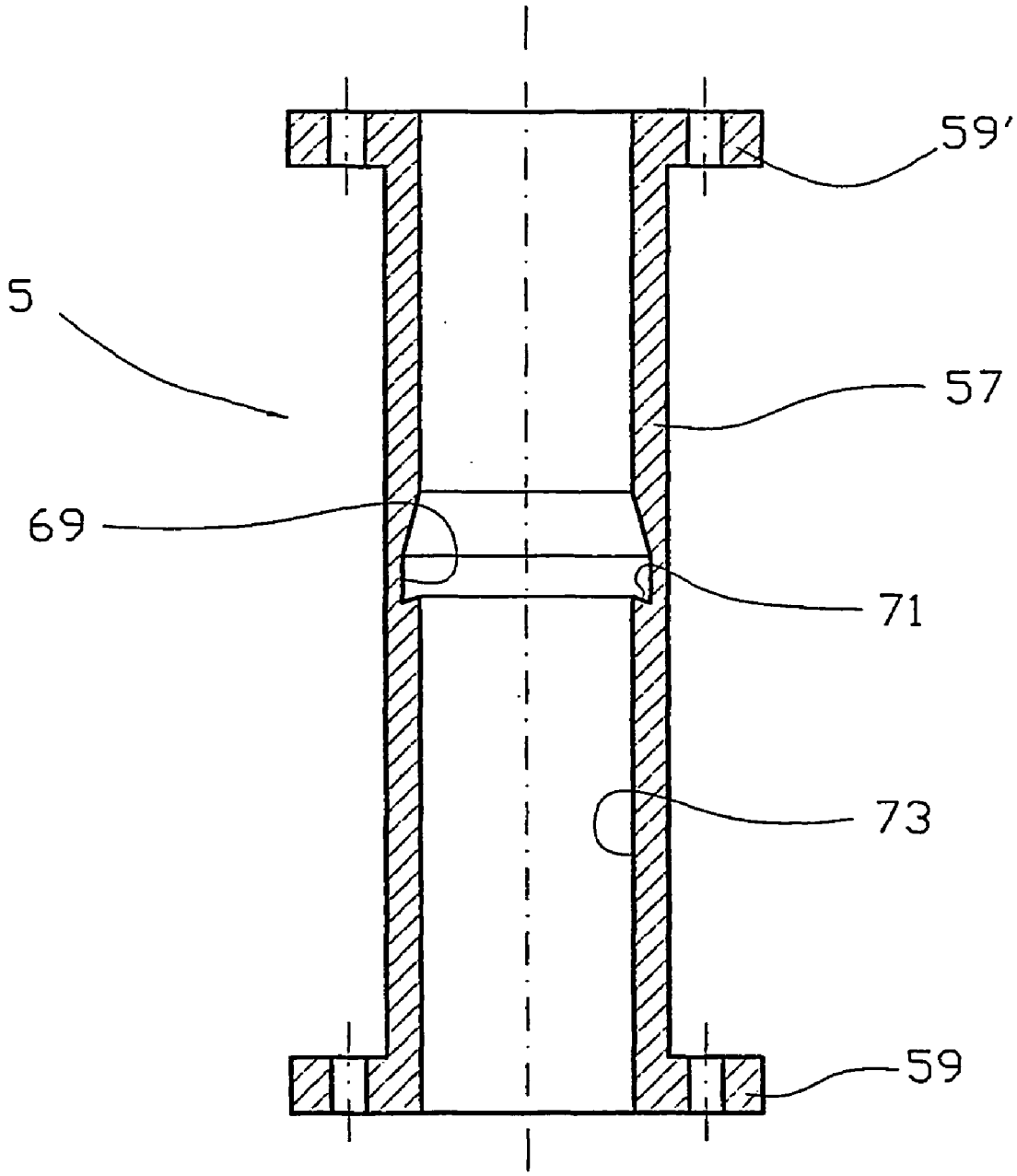
FIG. 4 shows a longitudinal section through the housing of the tubing tensioner unit, on a larger scale.

Reference is now made primarily to FIGS. 2 and 4. The housing 5 of the tubing tensioner unit comprises an essentially tubular main section 57 plus a flange 59, 59' placed at either end, which corresponds with a flange 61 on a riser 63 and a flange 65 on a telescopic unit 67. The flanges 59, 59', 61, 65 are connected with several through bolts 66. Internally, the main section 57 of the housing 5 is provided with an annular concentric recess 69 positioned approximately halfway between the flanges 59, 59' of the housing 5. A lower face 71 of the recess slopes slightly downwards from the inner wall 73 of the housing, so that the direction of the face 71 coincides with that of the lower ratchet face 37 (see FIG. 3) when the ratchet 25 is forced out from the cutout 23 in the lower gable 11.

Reference is further made to FIG. 3. The tubular cylinder 1 is connected via the hydraulic passage 19 to a hydraulic unit 75 that is known per se (shown schematically), and which comprises pipe 77, reservoir 79, pump 81 and control device 83.

Figure 5:
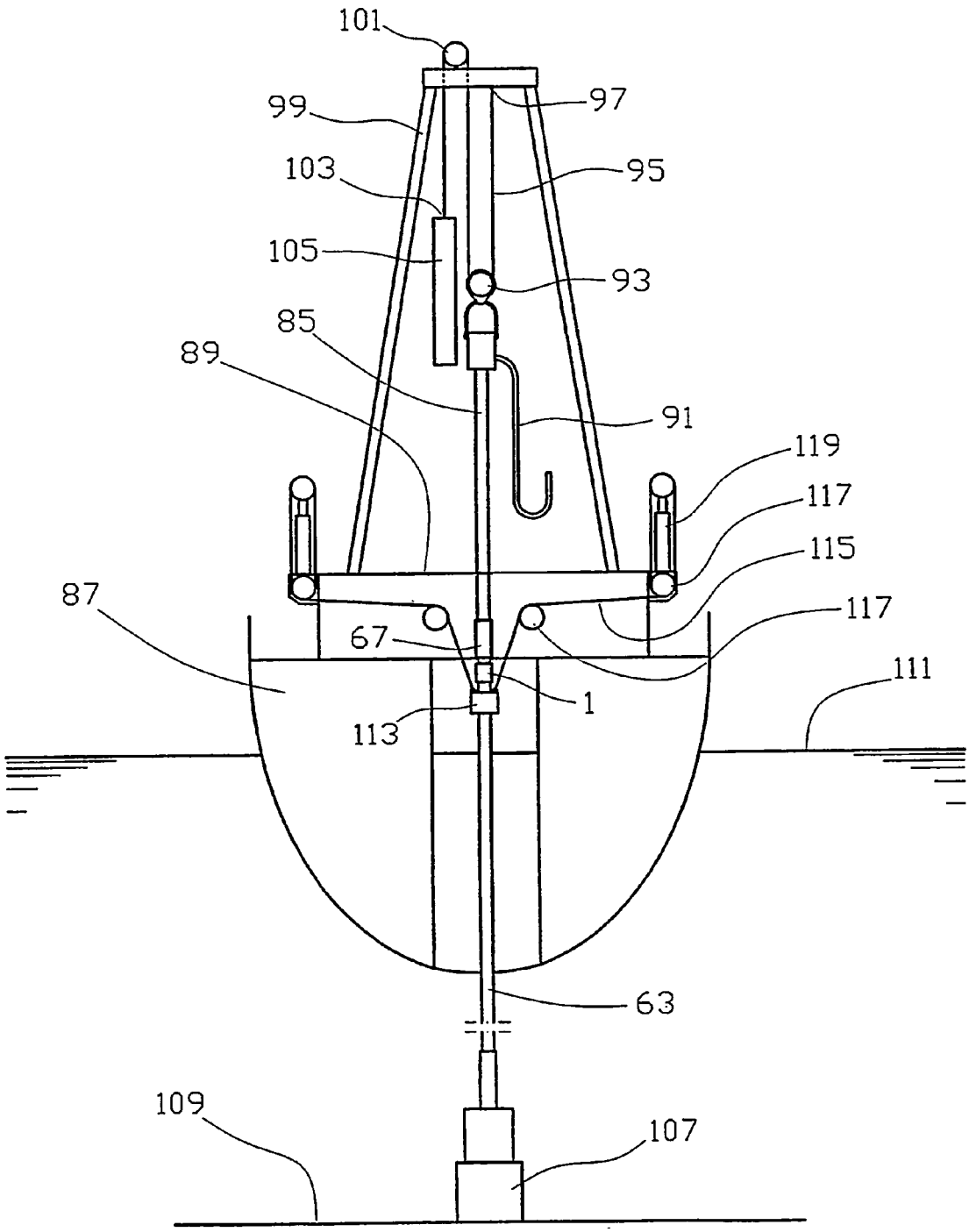
FIG. 5 shows a schematic drawing of a tensioning system according to the invention on a smaller scale, here shown in cross section through a drilling ship.

Reference is now made to FIGS. 2 and 5. A production tubing extension 85 is connected to the upper end portion 45 of the tubular cylinder 3 and projects above the production deck 89 of a floating installation 87, where the tubing extension 85 is coupled to a flexible hose 91 and a pulley 93. A wire 95 is attached to a tower 99, e.g. a derrick, by its first end 97, and is then passed down to and through the pulley 93 and up to and over a fixed pulley 101, and then down in the direction of the production deck 89. The other end 103 of the wire 95 is attached to a counterweight 105.

A riser 63 extends from a wellhead installation 107 on the seabed 109 and up towards the installation 87 floating on the surface of the sea 111. The riser is suspended from several tensioning wires 115 at a collar 113, which wires are connected via pulleys 117 to riser tensioners 119. The tension in the wires 115 is maintained by means of regulating devices (not shown).

The housing 5 is connected by its one flange 59 to the flange 61 on the riser 63, through use of bolts 66. The riser 63 is then completed with the telescopic unit 67 that is connected to the upper flange 59' of the housing 5 by means of bolts 66.

The riser 63 is kept under tension by means of the riser tensioners 119. A prescribed tension in the wires 115 is maintained by means of the regulating devices (not shown) that actuate the riser tensioners 119.

The production tubing 49 passes from the floating installation 87 down through the riser 63 to the wellhead installation 107. The tubular cylinder 3 is connected to the upper end of the production tubing 49 by means of the corresponding coupling devices 45, 47. Before connecting up, the length of the production tubing 49 is adjusted in relation to the position of the housing 5 on the riser 63, so that the ratchets 25 on the tubular cylinder 3 to all intents and purposes correspond with the annular recess 69 of the housing 5 when the production tubing 49 is lowered all the way to the wellhead installation 107 on the seabed 109. The production tubing extension 85 is connected to the upper end of the tubular cylinder 3 by means of the corresponding coupling devices 45', 47'.

The cylinder 7 with its flanges 9, 11 is then displaced up or down along the piston rod 43 until the ratchets 25 are forced out into the internal recess 69 of the housing 5 and abut the lower faces 71 of the recess 69.

The upper end of the tubing extension 85 is connected to the counterweight 105, so as to allow the counterweight 105 to keep the tension in the production tubing extension 85 by means of the pulleys 93, 101 and the wire 95.

The tubular cylinder 3, which is connected up to the hydraulic unit 75, is then pressurised. The piston 53 will subsequently seek to stretch the production tubing 49, the ratchets 25 ensuring that the cylinder 7 and its gables 9, 11 rest on the face 71 in the housing 5. The reaction forces from the tubular cylinder 3 are thereby transferred to the riser 63. The part of the production tubing 49 extending from the hydrocarbon well 107 up to the tubing tensioner unit 1 is stretched and suspended from the riser 63. Consequently only the upper part of the production tubing 49, i.e. the production tubing extension 85, has to be suspended from a tensioning device on the floating installation 87, and then in the form of the simple arrangement consisting of the counterweight 105, the wire 95 and the pulleys 93, 101.

The invention claimed is:

1. A device for tensioning and relieving production tubing, the production tubing extending from a subsea well up through a riser to a floating installation, wherein an extension of production tubing passes through a telescopic unit in an upper section of the riser, the device comprising:

a tubing tensioner disposed below and in the proximity of the lower end of the telescopic unit, the tubing tensioner comprising a cylinder section and a housing that is integrated in the riser, wherein the cylinder section comprises a piston and cylinder that are telescopically received by the housing;

the cylinder having plurality of ratchets adapted to engage an annular internal recess formed in a lower inner face of the housing;

the piston having an open inner diameter that forms a conduit between the production tubing and the production tubing extension and an outer diameter that is greater than the outer diameter of the production tubing; and an inlet for supply of pressurized fluid to a lower chamber of the cylinder.

2. The arrangement of claim 1, wherein the housing is a concentric tube having end portions provided with flanges suitable for complementary connection to the upper section of the riser and a lower end of the telescopic section.

3. The arrangement of claim 1, wherein the cylinder comprises lower and upper gables.

4. The arrangement of claim 3, wherein the lower gable comprises a plurality of recesses that each accommodate one of the plurality of ratchets, an upper end of each ratchet suspended in a swiveling manner from the gable such that the lower end of each ratchet swivels out primarily in a radial direction from the gable to project from the gable.

5. The arrangement of claim 3, wherein each ratchet comprises means for biasing the ratchet outward relative to the gable.

6. The device of claim 1, wherein an upper end portion of the production tubing extension is coupled to an above-sea tensioning apparatus.

7. The device of claim 6, wherein the above-sea tensioning apparatus comprises several pulleys, one or more wires, and one or more counterweights.

* * * * *